US007047900B2

(12) United States Patent
Nelson

(10) Patent No.: US 7,047,900 B2
(45) Date of Patent: May 23, 2006

(54) WATERCRAFT STORAGE APPARATUS AND METHOD

(75) Inventor: Bruce D. Nelson, South Haven, MN (US)

(73) Assignee: Boat Bunkers, Inc., South Haven, MN (US)

( * ) Notice: Subject to any disclaimer, the term of this patent is extended or adjusted under 35 U.S.C. 154(b) by 74 days.

(21) Appl. No.: 10/804,821

(22) Filed: Mar. 19, 2004

(65) Prior Publication Data

US 2004/0221789 A1 Nov. 11, 2004

Related U.S. Application Data

(60) Provisional application No. 60/456,530, filed on Mar. 20, 2003.

(51) Int. Cl.
*B63B 35/00* (2006.01)

(52) U.S. Cl. ..... 114/263; 114/222

(58) Field of Classification Search ..... 114/222, 114/263

See application file for complete search history.

(56) References Cited

U.S. PATENT DOCUMENTS

| | | | | |
|---|---|---|---|---|
| 1,973,813 A | | 9/1934 | Kelley | |
| 3,142,283 A | | 7/1964 | Fisher | |
| 3,205,851 A | * | 9/1965 | Wiswell, Jr. | 114/222 |
| 3,570,256 A | | 3/1971 | Thompson | |
| 3,685,477 A | | 8/1972 | Wood | |
| 4,026,233 A | | 5/1977 | Cox | |
| 4,046,094 A | | 9/1977 | Preiser et al. | |
| 4,215,644 A | | 8/1980 | Jackson | |
| 4,280,436 A | | 7/1981 | Jackson | |
| 4,280,437 A | | 7/1981 | Jackson | |
| 4,280,438 A | | 7/1981 | Jackson | |
| 4,280,439 A | | 7/1981 | Jackson | |
| 4,282,822 A | | 8/1981 | Jackson | |
| 4,686,920 A | | 8/1987 | Thomas | |
| 4,693,200 A | | 9/1987 | Noble | |
| 4,787,327 A | | 11/1988 | Porter | |
| 5,051,027 A | | 9/1991 | Horton | |
| 5,152,242 A | | 10/1992 | Bradley | |
| 5,184,914 A | | 2/1993 | Basta | |
| 5,279,244 A | | 1/1994 | Perez-Collazo | |
| 5,465,676 A | | 11/1995 | Falcaro | |
| 5,549,069 A | | 8/1996 | Faidi | |

(Continued)

FOREIGN PATENT DOCUMENTS

DE 196 26 190 A1 1/1998

(Continued)

OTHER PUBLICATIONS

"Barnacle Shield® Pays for itself in what you'd spend for just two bottom paintings (or sooner)," *Maritime Technologies Corporation*, 2 pgs.(© 1998).

*Primary Examiner*—Sherman Basinger
(74) *Attorney, Agent, or Firm*—Merchant & Gould P.C.

(57) ABSTRACT

A watercraft storage apparatus for protecting the hull of a watercraft both above and below the waterline without the need to lift or raise the watercraft out of a body of water. Inflatable side portion 11 protects the watercraft's hull above the waterline. A water-impervious lower sheet section 12 protects the watercraft's hull below the waterline. An aft section provides a drive-in ramp section 13 or a drop-down gate section 19 to provide ingress and egress of the watercraft from the storage apparatus.

19 Claims, 6 Drawing Sheets

U.S. PATENT DOCUMENTS

| | | | |
|---|---|---|---|
| 5,795,098 | A | 8/1998 | Rueckert |
| 5,860,379 | A | 1/1999 | Moody |
| 5,931,113 | A | 8/1999 | Eva, III et al. |
| 6,006,687 | A | 12/1999 | Hillman et al. |
| 6,047,658 | A | 4/2000 | Tansy |
| 6,152,061 | A | 11/2000 | Perez-Collazo |
| 6,349,662 | B1 | 2/2002 | Limansky et al. |
| 6,477,968 | B1 | 11/2002 | Powell |
| 6,568,343 | B1 | 5/2003 | Hill et al. |
| 2002/0132537 | A1 | 9/2002 | Hey |

FOREIGN PATENT DOCUMENTS

| | | | |
|---|---|---|---|
| EP | 0 360 436 | * | 3/1990 |
| WO | WO 80/00554 | | 4/1980 |
| WO | WO 98/28184 | | 7/1998 |

* cited by examiner

WATERCRAFT STORAGE APPARATUS AND METHOD

CROSS-REFERENCE TO RELATED APPLICATION

This application claims priority to provisional application Ser. No. 60/456,530, filed Mar. 20, 2003.

FIELD OF THE INVENTION

This invention relates generally to on-water storage systems for watercraft and more specifically to a floating enclosure apparatus for the protection of the hull of a watercraft from both physical contact damage and damage caused by biofouling while the watercraft is moored.

BACKGROUND OF THE INVENTION

As referred to herein, watercraft may include any type of water vessel such as powerboats, sailboats, or personal watercraft (PWC) used primarily for recreational purposes, as well as commercial water vessels or ships.

Owners of watercraft have the option of either removing their watercraft from the water for storage on land in between uses or they may keep their watercraft on the water by mooring it to a dock or pier or by stowing it in or on a boat storage device. To reduce the amount of time and effort required to remove, transport, store, and then re-launch the watercraft, many watercraft owners prefer to keep their watercraft on the water where it is more readily available for use. However, mooring a watercraft directly in the water can result in higher maintenance due to the build-up of marine growth and residue on the hull and due to possible physical damage that may be caused by the hull coming into contact with a dock or pier or with other floating objects due to wave, current, or tidal action.

Heretofore there have been two main approaches to protect a watercraft while it is kept on a body of water while not in use. One approach entails lifting the entire watercraft out of the body of water by a freestanding boatlift or permanently installed boat hoist. The other approach entails shielding the watercraft's hull below the waterline with an underwater hull enclosure.

Boatlifts and boat hoists that keep watercraft out of the water share a significant common logistical and handling drawback. Namely, because of their bulk, boatlifts and boat hoists are difficult and expensive to transport, install and remove for storage. Further, in many situations, boatlifts are impractical or impossible to use, as is the case where a watercraft is moored in deep water or where the bottom of the body of water is soft, irregular or severely sloped.

Many watercraft owners have available to them protected marinas or waterways where it may be safe to keep a watercraft moored in the water without benefit of a boatlift. In such situations, a watercraft can be simply secured to a dock or a pier without a fear of damage that may be caused from strong wave action. However, a variety of problems may occur when the hull of a watercraft remains in the water for a protracted period of time as a result of marine growth, which is present in virtually every body of water. In even in the cleanest of fresh water lakes, the formation of slime and algae occurs on the hulls of watercraft as a natural biological process. The formation of slime and algae not only detracts from the appearance of the watercraft, but can also lead to challenging and costly maintenance and impair the speed and performance of the watercraft while underway.

Biofouling, also referred to a bottom fouling, is the process of sea creatures and marine life attaching to the hulls, sides, bottoms, and running gear of the watercraft. The fouling process begins with the formation of slime, which can begin literally within minutes of the watercraft being put into the water. Depending upon the condition of the body of water, additional buildup of slime, grasses, and algae will occur. In saltwater areas, as well as in some bodies of fresh water, the fouling process becomes even more severe. After the slime buildup, additional buildup of mussels, barnacles, tubeworms, hydroids, anemones, sea squirts and other marine creatures can eventually cover the entire submerged surface of the hull. If left unattended, biofouling can severely limit the performance and efficiency of the watercraft and the hull of the watercraft can become severely damaged.

In saltwater areas, the most common method of dealing with bottom fouling is to periodically clean the watercraft's hull and refinish it with an anti-fouling paint. Cleaning the bottom of a watercraft is always a difficult, unpleasant and generally an expensive task. Further, some of the most effective anti-fouling paints have been found to be toxic and environmentally damaging to both the marine environment and in boat yards where old paint is scraped off and new paint is applied.

To address the bottom fouling issue, particularly in saltwater areas, several devices have been developed that inhibit marine growth by providing a watercraft hull enclosure that isolates the watercraft's hull from the surrounding water while it is at rest at a dock or mooring. Such devices provide a water-impervious envelope that is generally complementary to the underwater surface of a watercraft's hull and provides a shield against the surrounding body of water. By isolating the underwater surface of a watercraft's hull from the surrounding water, sunlight, and oxygen replenishment is restricted, which in turn retards the growth of marine organisms. The shield is supported at the waterline by attachment to a structure such as a pier or a dock or to a floating framework. The floating framework, in one example, incorporates rigid tubes with flotation structures attached such as foam. The frame floats at the waterline and the hull shield is suspended below the waterline. Such frames can be difficult to transport, difficult to assemble, and difficult to use.

Underwater hull enclosures protect only the watercraft's hull below the waterline and are suitable for use where the watercraft is moored in relatively calm and protected sites. Unfortunately, although the benefits of underwater hull enclosures are known, they have not enjoyed widespread use because of their generally cumbersome design.

Boatlifts and boat hoists protect the entire watercraft's hull but require structures capable of supporting the entire weight of the watercraft as well as a mechanism to elevate the watercraft to a level above the waterline. Both hull enclosures and boatlifts are made with generally large, rigid, heavy components that make them difficult to transport, set-up, relocate, or remove from the water. Thus, there is a clear need for further development of apparatus and methods for on-the-water storage of watercraft that protects the watercraft's hull both above and below the waterline without the need to utilize complex and relatively expensive lifts and supports.

SUMMARY OF THE INVENTION

This invention is an improved watercraft storage apparatus and method that provides protection of a watercraft's hull both above and below the waterline while the watercraft is moored in the water. One aspect of the invention isolates the underwater surface of the watercraft's hull from the surrounding water and thereby inhibits the growth of marine life on the underwater surface of the watercraft hull. Another aspect of the invention provides an inflatable collar that acts as a bumper to protect the watercraft's hull above the waterline and thus provides protection to the watercraft's hull without the need to lift or remove the watercraft out of the water.

One embodiment of a storage apparatus includes an inflatable structure into which the watercraft can be driven. The structure has inflatable sides and includes a flexible floor or lower sheet section that provides a shield around the hull of the watercraft. The inflatable sides of the structure surround the perimeter of the watercraft above the waterline and provides protection from damage that can be caused from wave action or from other objects striking the hull of the boat.

One preferred embodiment of the storage apparatus includes a ramp structure that allows the watercraft to be driven over the aft section of the storage apparatus to enter and exit the apparatus. In another preferred embodiment, the storage apparatus includes an aft gate that can be lowered to allow the watercraft to enter and leave the structure. Through isolation of the underwater surface of the watercraft's hull from the surrounding water, marine growth is prevented.

The lower sheet structure of the apparatus is preferably detachable. Detachability allows the lower sheet to be replaced if needed.

The storage apparatus of the preferred embodiment is constructed of generally flexible and comparatively lightweight materials, which allows the user to roll it up or otherwise compact the apparatus into a smaller area for easy storage and also allows the unit to be readily shipped.

DETAILED DESCRIPTION OF THE PREFERRED EMBODIMENT

Figure 1:
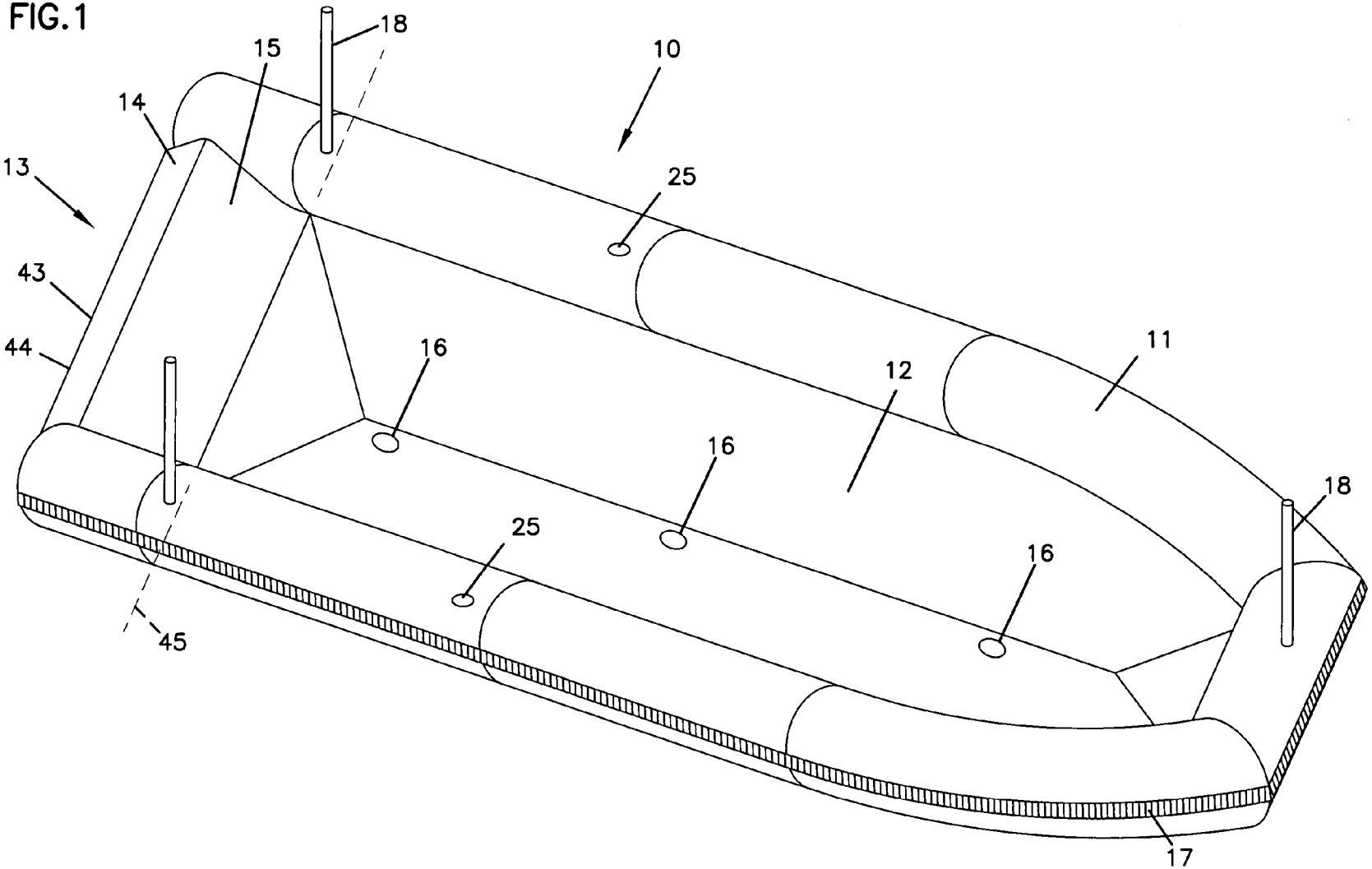
FIG. 1 is a top perspective view of one embodiment of a watercraft storage apparatus in accordance with the invention.

FIGS. 1–4 show one embodiment of a watercraft storage apparatus 10 including an inflatable side portion 11, a water-impervious lower sheet section 12, and an access device 13 in the form of a ramp 43. In the illustrated embodiment, access device 13 forms a moveable aft section to allow a watercraft to enter and exit an interior of watercraft storage apparatus 10.

Figure 2:
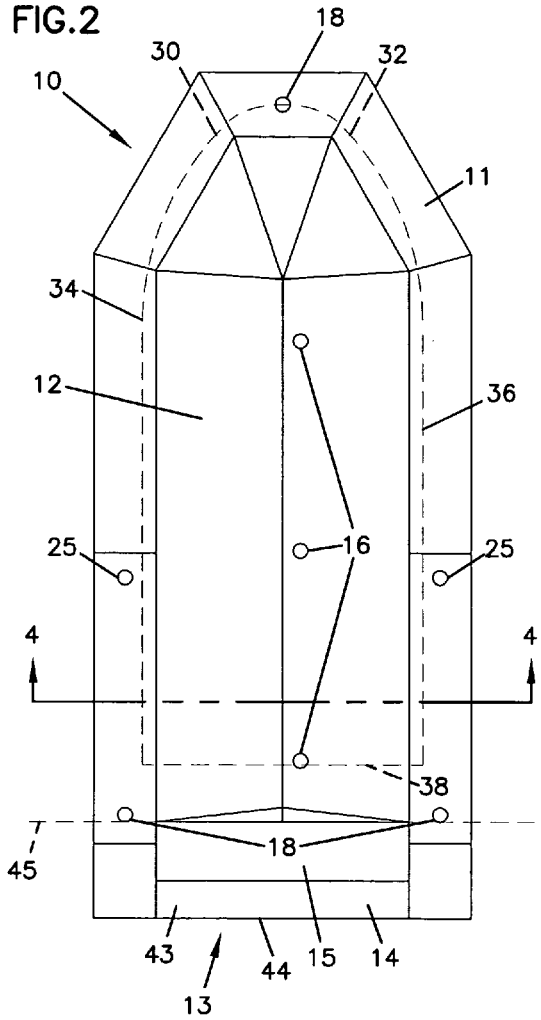
FIG. 2 is a top view of the watercraft storage apparatus of FIG. 1.
Figure 3:
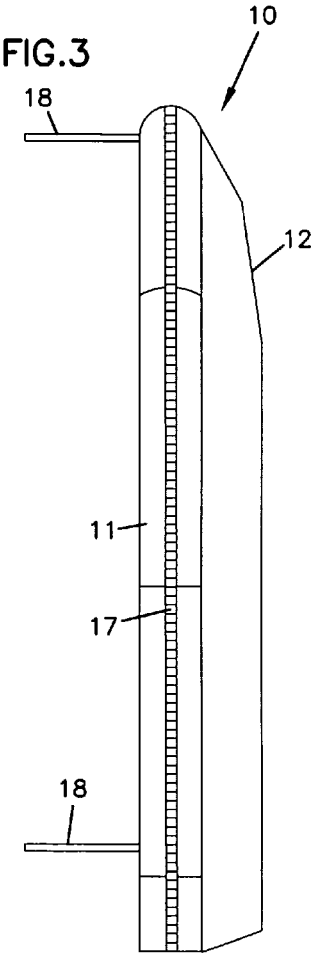
FIG. 3 is a side view of the watercraft storage apparatus of FIG. 1.
Figure 4:
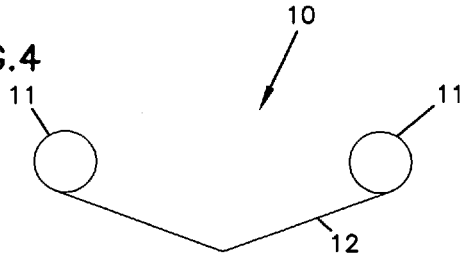
FIG. 4 is a cross-sectional view of the watercraft storage apparatus along lines 4—4 of FIG. 2.
Figure 13:
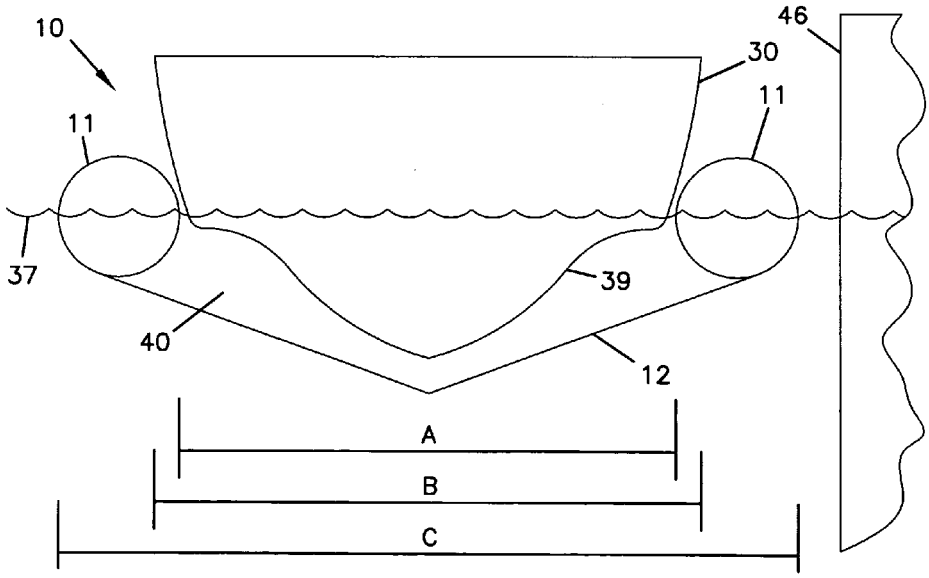
FIG. 13 shows the cross-section of FIG. 4 with a watercraft positioned within the watercraft storage apparatus.

Inflatable side portion 11 surrounds the perimeter of watercraft along the bow and sides of the watercraft. FIG. 2 and FIG. 13 show a watercraft 30 surrounded by side portion 11. Side portion 11 forms a collar or bumper around watercraft 30. Side portion 11 in the inflated condition forms a freestanding structure which maintains its general U-shape without additional frames or other supports.

Inflatable side portion 11 floats in water and helps support the additional structures of apparatus 10. The preferred shape of side portion 11 is one that closely follows the hull at the waterline. The shape can be varied for different apparatus 10 designed for watercraft having different hull shapes. FIGS. 1 and 2 show a generally U-shape bow section, which is suitable for many types of watercraft, including by way of example, PWC's. A V-shape bow section would be preferred for many types of runabout and power boats. A square-shaped bow section would be preferred for pontoon boats and other watercraft with squared off bows or multiple hulls, such as catamarans.

While aspects of apparatus 11, such as access devices 13, may still be advantageous with a side portion 11 that offers little or no above waterline protection from contact, the preferred apparatus 11 has an appropriate size to protect the hull up to the above waterline portions that may come into contact with piers, docks, or floating debris.

Inflatable side portion 11 can be made from materials capable of holding air for extended periods and may have one or more air chambers. Preferably, the inflatable sides will be made of reinforced material such as Hypolon® or PVC coated woven polyester to resist abrasion and enhance puncture protection. Further, the seams of the inflatable sides are preferably heat-sealed or RF welded and reinforced. Each chamber incorporates an air valve 25, which allow watercraft storage apparatus 10 to be inflated at the time the unit is installed and deflated for storage. Inflatable side portion 11 is kept inflated at all times when in use. There is no need to deflate and re-inflate the entire structure each time it is used.

Inflatable side portion 11 provides floatation for apparatus 10. In use, side portion 11 surrounds watercraft 30 (see FIG. 2) along a bow 32, and sides 34, 36 of watercraft 30. Ramp 43 is positioned adjacent to a stern 38 of watercraft 30.

Lower sheet section 12 is designed to conform generally to the undersurface of the watercraft's hull. It can be made out of any water-impervious material that either drapes below the watercraft's hull or floats up against the watercraft's hull. Polyvinylchloride, polyolefin, and polyethylene sheet materials can be used. Lower sheet section 12 may be permanently attached to side portion 1, or as will be described below, lower sheet section 12 can be selectively detachable, such as for cleaning, storage, or replacement.

As shown in FIGS. 1 and 2, bailer valves or one-way checks valves 16 preferably are incorporated into the lower sheet section 12 so as to evacuate the water from watercraft storage apparatus 10. The material used for lower sheet section 12 may also incorporate an imbedded biocide, such as oxides and metal organic compounds of copper or tin and other metals, to further help prevent the growth of marine organisms and corrosion to the watercraft's hull and equipment.

Rub guards 17 may be attached to the outside of inflatable side portion 11 to provide further protection to watercraft storage apparatus 10 during periods where it may bump against or otherwise come into contact with the sides of a dock or pier or other watercraft or floating objects due to wave, current, or tidal action. Vertically oriented guideposts 18 may be attached to one or more locations on the top or sides of inflatable side portion 11 to provide a visual aid while navigating the watercraft into the storage apparatus.

Ramp 43 is located in the aft section of the watercraft storage apparatus 10. Ramp 43 is coupled to the inflatable side portion 11 and lower sheet section 12. Ramp 43 has sloped surfaces on both outside ramp surface 14 and inside ramp surface 15 and may be constructed from rigid or semi-rigid materials. Either or both of ramp surfaces 14 and 15 may be flat or contoured to accommodate the shape of watercraft hulls. At least a portion of ramp 43 is preferably buoyant so that at least a portion floats above the waterline, which thereby maintains that portion of lower sheet section 12 that is attached to ramp 43 above the waterline when ramp 43 is in the raised position. Ramp 43 is pivoted about axis 45 to allow watercraft 30 to enter or exit apparatus 10. Free end 44 pivots down to allow the watercraft to enter or exit.

Figure 5:
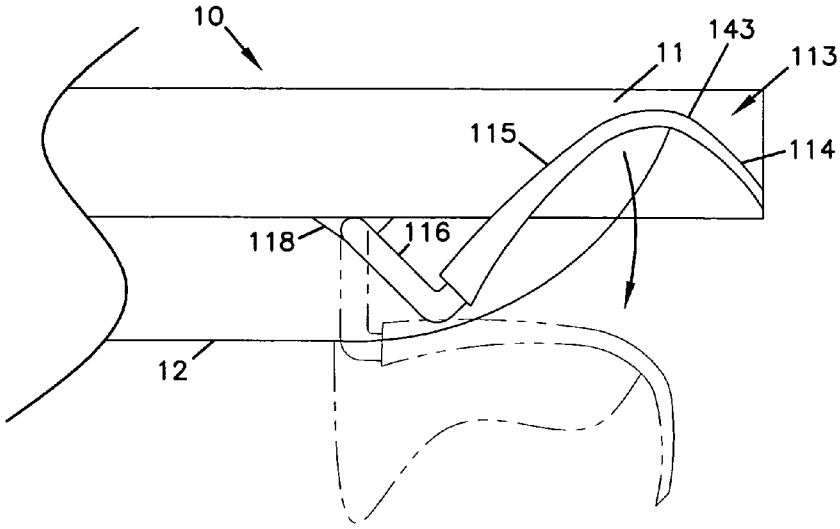
FIG. 5 is a cross-sectional view of the aft section of the watercraft storage apparatus of FIG. 2 showing an alternative ramp.

Ramp 43 is show as planar portions in FIGS. 1 and 2. FIG. 5 shows a further embodiment of an access device 113 in the form of a pivoting ramp 143 including a bar 116 pivotally mounted to a bracket 118 which is mounted to side portion 11 on each side of apparatus 10. Access device 113 includes an outside ramp surface 114, and an inside ramp surface 115. As shown in FIG. 5, ramp 143 pivots downwardly to allow the watercraft to enter and exit apparatus 10, with lower sheet 12 attached to the underside of ramp 143.

Figure 6:
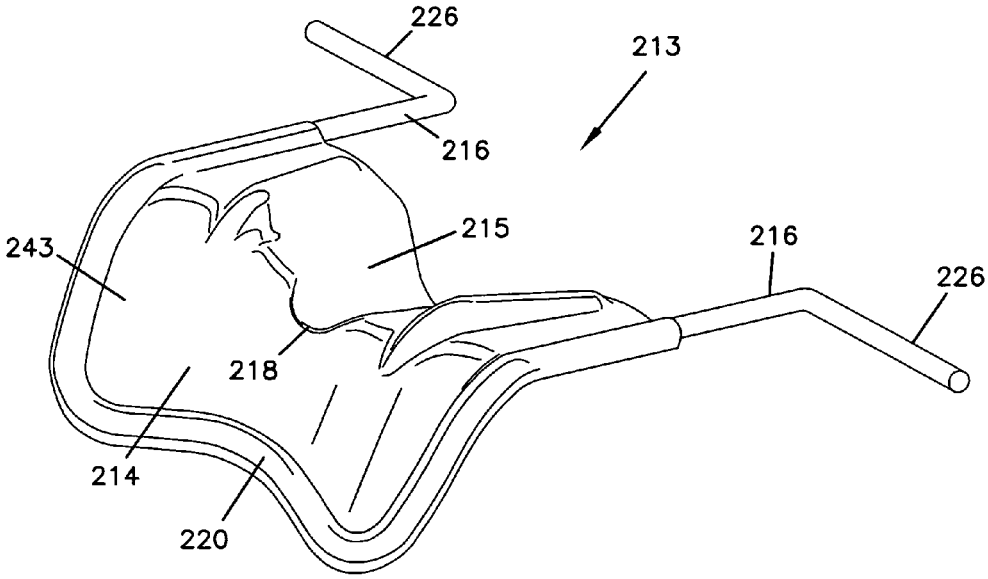
FIG. 6 is a perspective view of a further alternative ramp to the ramp of FIG. 5.

FIG. 6 shows another embodiment of an access device 213 in the form of a ramp 243. Bars 216 include arms 226 for receipt in brackets 118 as shown in FIG. 5. Outside ramp surface 214 and inside ramp surface 215 are contoured to interface with the hull of the watercraft. Cutout 218 is specially sized to avoid contact with the rear portion of the watercraft, such as the rear jet of a personal watercraft.

Figure 7:
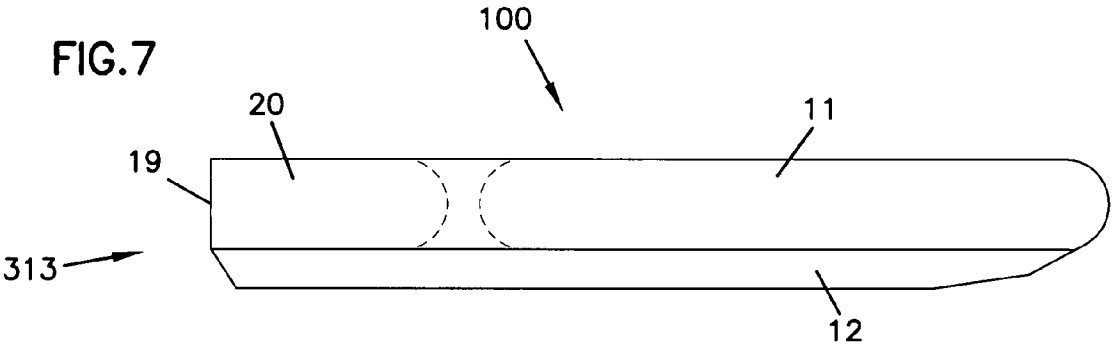
FIG. 7 is a side view of an alternative embodiment of a watercraft storage apparatus showing a drop-down gate in a raised position.
Figure 8:
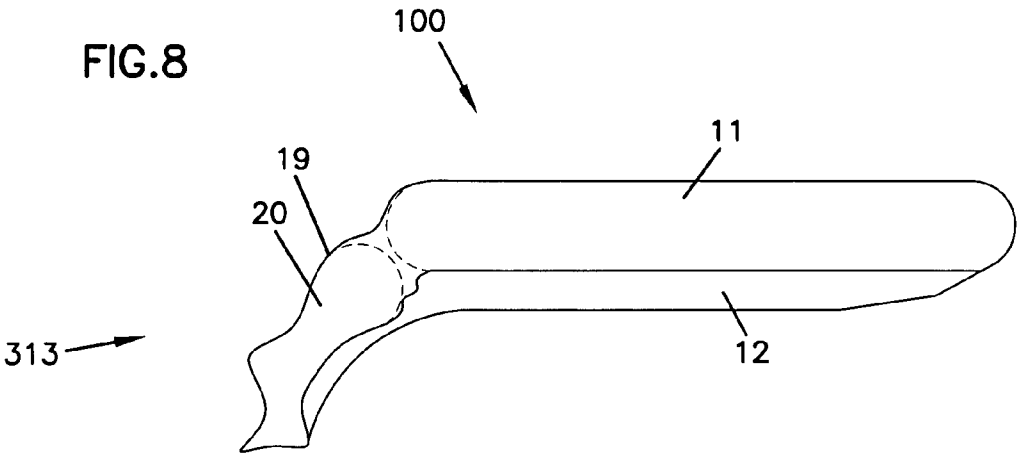
FIG. 8 is a side view of the watercraft storage apparatus showing the drop-down gate in the lowered position.

Referring now to FIGS. 7 and 8, a watercraft storage apparatus 100 may incorporate a drop-down gate 19 forming an access device 313 so as to allow the watercraft to enter and exit. The gate may be made as a U-shaped inflation chamber 20 surrounding the stern portion of the watercraft that can be deflated for lowering and inflated for raising as illustrated in FIGS. 7 and 8. The gate can alternately be made from rigid components to form a U shape that is hinged to the inflatable sides 11 and weighted for lowering.

Figure 9:
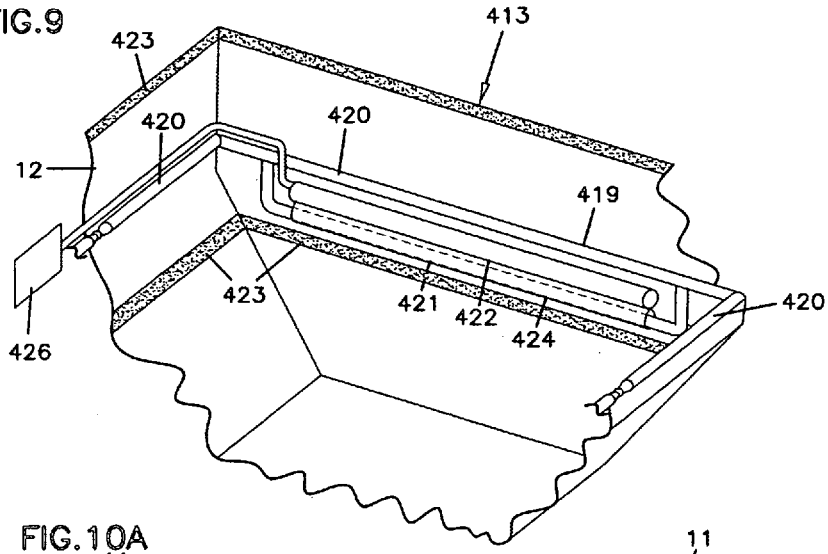
FIG. 9 is a perspective view of another embodiment of a drop-down gate.

FIG. 9 shows an alternative access device 413. Frame 419 has an upper member 420 and a lower member 421 and houses air bladder 422 which is selectively inflatable with air. The lower sheet section 12 is attached to frame 419 by wrapping it around frame 419 and attaching it to the inside of lower sheet section 12 by hook and loop fastener 423. Air bladder 422 incorporates an external sleeve 424, which slides over the lower member 421 of frame 419. With this configuration, air bladder 422 provides buoyancy to raise the upper member 420, together with the lower sheet 12 above the waterline. Further, upper member 420 provides weight above the waterline to facilitate submerging frame 419 when air bladder 422 is deflated. Air bladder 422 may be inflated by any suitable air pump or inflator 426, which may be manually operated or operated by remote control.

Figure 10A:
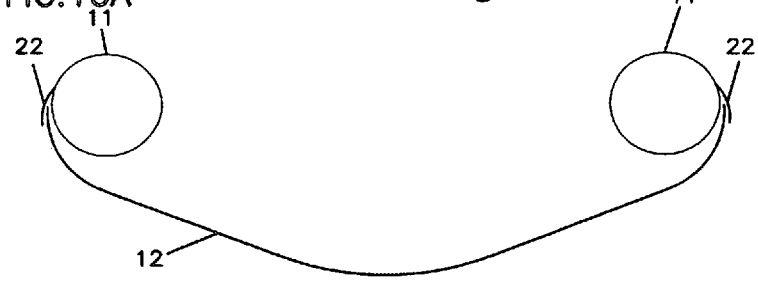
FIG. 10A is a cross-sectional view of the watercraft storage apparatus of FIG. 4 including a detachable lower sheet section.
Figure 10B:
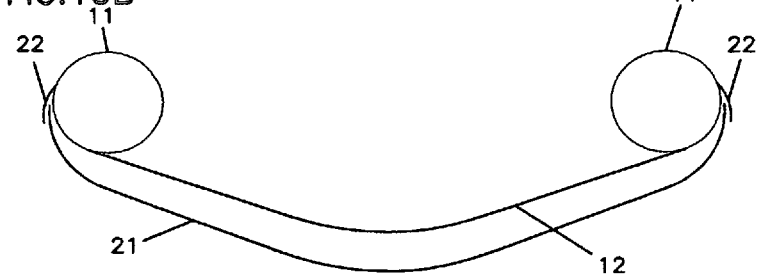
FIG. 10B is a cross-sectional view of the watercraft storage apparatus of FIG. 4 including a detachable undershield.
Figure 11:
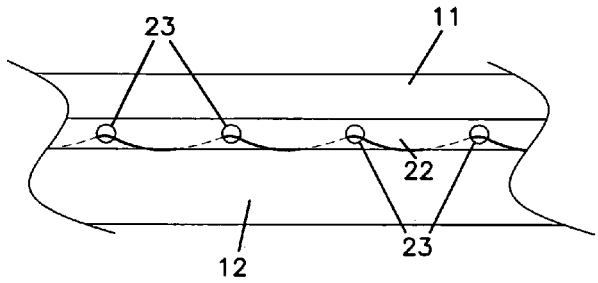
FIG. 11 is a side view showing one embodiment of attachment system for the lower sheet section and undershield.
Figure 12:
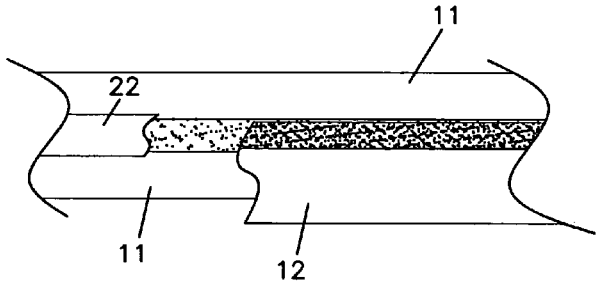
FIG. 12 is a side view showing another embodiment of an attachment system for the lower sheet section and undershield.

As previously stated, lower sheet section 12 may be permanently attached to inflatable side portion 11, or it may be detachable from inflatable side portion 11 as shown in FIG. 10A. Alternatively, FIG. 10B shows lower sheet section 12 attached to inflatable side portion 11 and a detachable undershield 21. Undershield 21 is made with flexible material that envelops the entire undersurface of the watercraft storage apparatus 10 and thereby protects the watercraft storage apparatus from marine growth. As with lower sheet section 12, undershield 21 may incorporate an imbedded biocide and/or anti-corrosion agent to further help prevent the growth of marine organisms and corrosion to undershield 21 and watercraft storage apparatus 10. Undershield 21 is attached to the watercraft storage apparatus 10 around its entire perimeter. FIGS. 11 and 12 illustrate two ways by which lower sheet section 12 or undershield 21 may be attached to inflatable side portion 11 of watercraft storage apparatus 10. FIG. 11 shows grommets and a cord for attaching to flap 22. FIG. 12 shows hook and loop fasteners for attaching to flap 22. In both cases it is desirable to have the lower sheet 12 or the undershield 21 easily detachable for cleaning, storage or transportation.

Because watercraft storage apparatus 10 is constructed with generally flexible materials it can be readily shipped and transported. To install watercraft storage apparatus 10, the user unpacks the entire unit, attaches detachable lower sheet section 12 and undershield 21, as required, then inflates inflatable side portion 11. The user attaches aft ramp 43 or gate 19 (if separate), and then places inflated watercraft storage apparatus 10 in the boat slip or adjacent dock or pier. The watercraft storage apparatus can be attached to the dock or pier by various means, which include but are not limited to securing by ropes, including conventional dock lines. Alternatively, or in addition, the watercraft storage apparatus may also be attached to anchor devices resting on or attached to the bottom of the body of water, or it may be attached by means of brackets or an attachment frame, which in turn are attached to the dock, pier of pilings.

Once the watercraft storage apparatus is installed and secured, it is ready for use. To enter the unit, the watercraft operator simply approaches the storage apparatus as though the operator were docking their boat. Vertically oriented guideposts 18 provide a visual reference for properly positioning the watercraft as it enters the watercraft storage apparatus. As the bow of the watercraft reaches ramp 43, the hull comes into contact with outside ramp surface 14 and as the bow rides up onto outside ramp surface 14, it forces ramp 43 downward below the waterline, allowing the watercraft to enter the watercraft storage apparatus. After the stern of the watercraft passes over outside ramp surface 14 and then inside ramp surface 15, ramp 43 rises back above the waterline with lower sheet section 12 attached to it.

Once inside watercraft storage apparatus 10, the watercraft is surrounded around its perimeter with inflatable side portion 11 and ramp 43, which will protect the watercraft's hull from coming into contact with a stationary object such as a dock or a pier or from floating objects that might otherwise damage the watercraft's hull.

Lower sheet section 12 envelops the entire hull of the watercraft below the waterline and isolates the watercraft's hull from the surrounding water. Lower sheet section 12 may be made with material that floats so that lower sheet section 12 presses against the underwater surface of the watercraft after it has entered the watercraft storage bunker. Bailer or one-way check valves 16, located in lower sheet section 12, allow the water to drain out of the watercraft storage apparatus so that the watercraft hull has minimal contact with water. The isolation of the hull of the watercraft from the surrounding water effectively limits the growth of marine life because light and oxygen replenishment is required to sustain growth. Further, a biocide may be imbedded into the material of lower sheet section 12 or a biocide and or cleaning agent or fresh water may be introduced to the inside of the watercraft storage apparatus to further reduce marine growth and to actually clean the hull of the watercraft. Chlorine and natural enzyme products have proven to be effective in this regard.

When the watercraft operator is ready to depart, the watercraft is merely pushed rearward so that its stern comes into contact with inside ramp surface 15 of ramp 43. As the stern of the watercraft passes over surface 15, ramp 43 is again forced downward, allowing the watercraft to exit from the watercraft storage apparatus 10. Typically, ramp 43 is best suited for smaller boats and particularly for personal watercraft (PWC's).

For larger watercraft, including those equipped with inboard engines with drive shafts that emerge from the underside of the watercraft, or sailboats with a keel projecting below the underside of the watercraft, or where other equipment, such as trim tabs are attached to the transom of the watercraft, the alternative watercraft storage apparatus shown in FIGS. 7–9 are applicable. Instead of ramp 43, watercraft storage apparatus 100 includes gates 19, 419 that can be lowered below the waterline. Gates 19, 419 may be weighted and have lines attached to it that are used to secure the gate in the raised position when the watercraft is in the storage apparatus. When the watercraft is ready to be removed, the lines are released so that gate 19 drops down below the waterline allowing the watercraft to exit. Alternatively, gate 19 can be mechanically raised and lowered by one or more air, hydraulic, or water cylinders, or it may be made as an inflation chamber 20 as shown in FIGS. 7 and 8 that can be deflated for lowering and inflated for raising. When gate 19 is in the lower position, the watercraft can readily enter and depart the watercraft storage apparatus 100.

In some water conditions, such as in saltwater areas or those that are more prone to bottom fouling, it is desirable to have the lower sheet section 12 detachable from the inflatable sides 11 so that it may be readily removed for cleaning or replacement. Alternatively, a detachable undershield 21 may be affixed to the watercraft storage apparatus. In use, undershield 21 is attached around the entire outside perimeter of the storage apparatus above the waterline and thereby envelop the entire underwater surface of the watercraft storage apparatus. Marine growth that would otherwise attach to the underwater surface of the watercraft storage apparatus will become attached to the undershield 21. When undershield 21 becomes fouled with marine growth, it is removed and replaced with a new undershield. Undershield 21 may be made of lightweight flexible material that protects the underwater portions of the watercraft storage apparatus from marine growth. The lower sheet 12 or the undershield 21 may be attached to the watercraft storage apparatus by any suitable method so as to allow easy removal and attachment. One such attachment method, as shown in FIG. 10, is an attachment flap 22 that is attached to the inflatable side portion 11. In this illustration, the flap 22 incorporates a plurality of grommets 23, which provide attachment points for lower sheet section 12 or undercover shield 21. Other fastening structures, including using a hook and loop fastening system, may also be used as shown in FIG. 12.

If the storage apparatus needs to be removed from the water, as may be the case in northern climates, or if the owner simply wants to relocate the storage apparatus, the user simply deflates the side portion 11 and removes the aft section 13 or 19 as necessary. The storage apparatus can then be rolled up or folded for ready storage or transport without the need to dismantle or otherwise employ the aid of several people or tow vehicles to remove it.

The size or shape of the storage apparatus can be varied without departing from the basic design elements of the invention. For example the storage apparatus can be designed large enough to accommodate a very large ship or small enough to accommodate small watercraft including by way of example inflatable boats, dinghies, canoes, and PWC's. The shape of the watercraft storage apparatus can be made suitable for elongated high performance off-shore power boats, or can be made rectangular to accommodate pontoon or catamaran style watercraft.

Tables 1–3 show various example sizes for apparatus 10, 100

TABLE 1

Small Craft

| Boat Type | PWC | Tenders/RIB's |
|---|---|---|
| Boat LOA | 12'-9" | 14'-0" |
| Water Line Length | 10'-9" | 16'-0" |
| Water Line Width | 4'-4" | 5'-6" |
| Hull Depth | 18" | 12" |
| Aft Depth | 18" | 24" |
| Outside Unit Dimensions | 14' × 6' | 16' × 7.5' |

TABLE 2

Standard Outboards, I/O's-Runabouts and Cruisers

| Boat Type | V Hull | V Hull | V Hull | V Hull | V Hull |
|---|---|---|---|---|---|
| Boat LOA | 20'–0" | 24'–0" | 28'–0" | 32'–0" | 36'–0" |
| Water Line Length | 22'–6" | 26'–6" | 30'–6" | 34'–6" | 38'–6" |
| Water Line Width | 7'–6" | 8'–0" | 9'–0" | 10'–0" | 12'–0" |
| Hull Depth | 24" | 26" | 28" | 30" | 32" |
| Aft Depth | 39" | 41" | 43" | 45" | 48" |
| Outside Unit Dimensions | 24.5' × 9.5' | 28.5' × 10' | 32.5' × 11' | 36.5' × 12' | 40.5' × 14' |

TABLE 3

| Catamarans, Deck Boats and Pontoons | | | |
|---|---|---|---|
| Boat Type | Cats/Decks/ Pontoons | Cats/Decks/ Pontoons | Cats/Decks/ Pontoons |
| Boat LOA | 25'-0" | 30'-0" | 35'-0" |
| Water Line Length | 28 | 33 | 38 |
| Water Line Width | 8'-6" | 9'-0" | 9'-6" |
| Hull Depth | 12 | 18 | 24 |
| Aft Depth | 39" | 39" | 39" |
| Outside Unit Dimensions | 30' × 10.5' | 35' × 11' | 46' × 14' |

Preferably inflatable side portion 11 is cylindrical in cross-section. Preferably, the cylindrical portions of inflatable side portion 11 are between 6.0 and 18.0 inches in diameter for the boats noted in Tables 1–3. Larger diameter inflatable side portion 11 would of course be used for larger watercraft. For PWC's and watercraft up to 36 feet, it is believed that diameters between 9.0 and 12.0 inches will provide appropriate hull protection. Of course, side portions 11 can be larger such as in the range of 18.0 inches to 48.0 inches or more which can be used for larger watercraft.

In the preferred embodiment, watercraft storage apparatus 10 protects watercraft 30 above and below the waterline 37. As shown in FIG. 13, watercraft 30 is protected by inflatable side portions 11 from contacting a dock or pier 46, or from floating debris. Apparatus 10 is sized to enclose and protect the watercraft from damage. Watercraft 30 has a maximum beam dimension of A, and inflatable side portion 11 has a maximum dimension C greater than dimension A. An inside of side portion 11 is preferably sized to closely surround the watercraft. For example, inner dimension B for side portion 11 is sized smaller than dimension A, the maximum dimension of the beam of the watercraft. As also shown in FIG. 13, lower sheet section 12 protects the lower hull 39 from biofouling by enclosing hull with an area of water 40 that does not support marine growth. By closely surrounding the hull with side portion 11 and sheet section 12, greater marine growth protection is provided.

Because of the design elements of the watercraft storage apparatus 10, which includes inflatable side portion 11, flexible water-impervious lower sheet section 12 and aft ramp 13 or gate 19, a watercraft is protected both above and below the waterline without the requirement to bring or otherwise lift the watercraft out of the water. Eliminating the need to provide for a structure—whether fixed or floating—that is capable of supporting the weight of the watercraft greatly simplifies the design, construction and expense of the watercraft storage apparatus 10. Because it can be packaged in a relatively compact form, it also allows for easy and widespread distribution of the product in commerce and provides a simplified and convenient watercraft storage method for watercraft of all kinds.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A watercraft storage apparatus for storing a watercraft in water, the watercraft having a hull and a bow, two sides, and an aft, comprising:

an inflatable portion that surrounds the sides and the bow of the watercraft above the waterline and is sized to provide protection of an above waterline section of the hull from damage that can be caused from wave action or from other objects striking or coming into contact with the hull;

a flexible, water-impervious, lower sheet section attached to the inflatable portion that envelops the under waterline section of the hull; and a moveable aft section mounted to the inflatable portion that allows for entry and exit of the watercraft from an area bounded by the inflatable portion and the aft section, wherein the inflatable portion maintains a general U-shape due to air pressure in the inflatable portion, wherein the inflatable portion lacks a rigid frame structure, and wherein the movable aft section includes a rigid portion defining a general U-shape, wherein the aft section includes a U-shaped drop-down gate defined by rigid tubing that is movable up or down, wherein the drop-down gate is selectively controllable by an air bladder and an air pump.

2. The watercraft storage apparatus of claim 1, further comprising an undershield that is attached to the inflatable portion below the lower sheet section.

3. The watercraft storage apparatus of claim 1, further comprising at least one vertically oriented guidepost that provides a visual reference to positioning the watercraft in the watercraft storage apparatus.

4. The watercraft storage apparatus of claim 1, wherein the lower sheet section is made from buoyant material.

5. The watercraft storage apparatus of claim 1, wherein the lower sheet section includes at least one check valve.

6. The watercraft storage apparatus of claim 1, wherein the lower sheet section is embedded with a biocide.

7. The watercraft storage apparatus of claim 1, wherein the lower sheet section is detachable from the inflatable portion and the moveable aft section.

8. The watercraft storage apparatus of claim 1 wherein the inflatable sides are made with puncture and abrasion resistant material and with seams that are heat sealed or RF welded and reinforced.

9. The watercraft storage apparatus of claim 1, wherein the inflatable portion includes a rub guard on the outside perimeter thereof.

10. The watercraft storage apparatus of claim 1, wherein the inflatable portion has a cylindrical cross-section between about 6.0 to 18.0 inches in diameter.

11. The watercraft storage apparatus of claim 1, wherein the inflatable portion has a cylindrical cross-section is at least 9 inches or more in diameter.

12. A watercraft storage apparatus for storing a watercraft in water, the watercraft including a hull, a bow, two sides, and an aft, comprising:

an inflatable portion that surrounds the sides and bow of the watercraft above the waterline and is sized to provide protection of an above waterline section of the hull from damage that can be caused from wave action or from other objects striking or coming into contact with the hull;

a flexible, water-impervious, lower sheet section attached to the inflatable portion that envelops the under water line section of the hull; and a moveable aft section mounted to the inflatable portion that allows for entry and exit of the watercraft from an area bounded by the inflatable portion and the aft section, wherein the aft section includes a ramp that is pivotably attached to the inflatable portion, the ramp having a sloped outside surface and a sloped inside surface, wherein the ramp is buoyant in the water.

13. The watercraft storage apparatus of claim 12, further comprising an undershield that is attached to the inflatable portion below the lower sheet section.

14. The watercraft storage apparatus of claim 12, wherein the lower sheet section is detachable from the inflatable portion and the moveable aft section.

15. The watercraft storage apparatus of claim 12, wherein the inflatable portion has a cylindrical cross-section between about 6.0 to 18.0 inches in diameter.

16. The watercraft storage apparatus of claim 15, wherein the inflatable portion has a cylindrical cross-section at least 9 inches or more in diameter.

17. A watercraft storage apparatus for storing a watercraft in water, the watercraft including a hull, a bow, two sides, and an aft, comprising:

an inflatable portion that surrounds the sides and bow of the watercraft above the waterline and is sized to provide protection of an above waterline section of the hull from damage that can be caused from wave action or from other objects striking or coming into contact with the hull;

a flexible, water-impervious, lower sheet section attached to the inflatable portion that envelops the under water line section of the hull; and a moveable aft section mounted to the inflatable portion that allows for entry and exit of the watercraft from wherein the aft section includes a U-shaped gate, wherein the U-shaped gate includes rigid tubing and a selectively inflatable bladder disposed outside of the rigid tubing, the inflatable bladder positioned below a first rigid tubing, and above a second rigid tubing.

18. A watercraft storage apparatus for storing a watercraft in water, the watercraft having a hull and a bow, two sides, and an aft, comprising:

an inflatable portion that surrounds the sides and the bow of the watercraft above the waterline and is sized to provide protection of an above waterline section of the hull from damage that can be caused from wave action or from other objects striking or coming into contact with the hull;

a flexible, water-impervious, lower sheet section attached to the inflatable portion that envelops the under water-line section of the hull; and a moveable aft section mounted to the inflatable portion that allows for entry and exit of the watercraft from an area bounded by the inflatable portion and the aft section, wherein the aft section includes a pivotably mounted drive-in ramp with a sloped outside surface and a sloped inside surface, wherein at least a portion of the ramp is buoyant.

19. A watercraft storage apparatus for storing a watercraft in water, the watercraft having a hull and a bow, two sides, and an aft, comprising:

an inflatable portion that surrounds the sides and the bow of the watercraft above the waterline and is sized to provide protection of an above waterline section of the hull from damage that can be caused from wave action or from other objects striking or coming into contact with the hull;

a flexible, water-impervious, lower sheet section attached to the inflatable portion that envelops the under water-line section of the hull; and a moveable aft section mounted to the inflatable portion that allows for entry and exit of the watercraft from an area bounded by the inflatable portion and the aft section, wherein the inflatable portion maintains a general U-shape due to air pressure in the inflatable portion, wherein the inflatable portion lacks a rigid frame structure, and wherein the movable aft section includes a rigid portion defining a general U-shape, wherein the aft section includes a pivotably mounted drive-in ramp with a sloped outside surface and a sloped inside surface, wherein at least a portion of the ramp is buoyant.

* * * * *